US012134513B2

(12) United States Patent
Knobloch et al.

(10) Patent No.: US 12,134,513 B2
(45) Date of Patent: Nov. 5, 2024

(54) ARRAY OF SANITARY TISSUE PRODUCTS

(71) Applicant: The Procter & Gamble Company, Cincinnati, OH (US)

(72) Inventors: Thorsten Knobloch, Brookline, MA (US); Michael Ricardo Burns, Cincinnati, OH (US); Jennifer Lori Steeves-Kiss, Orinda, OH (US); Illya Torrance Thomas, Cincinnati, OH (US); John Paul Brase, Mason, OH (US); Dennis Xavier Legault, Mason, OH (US); Dean Larry Duval, Lebanon, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 18/494,835

(22) Filed: Oct. 26, 2023

(65) Prior Publication Data

US 2024/0051734 A1 Feb. 15, 2024

Related U.S. Application Data

(63) Continuation of application No. 18/049,693, filed on Oct. 26, 2022, now Pat. No. 11,834,256, which is a (Continued)

(51) Int. Cl.
*B65D 85/62* (2006.01)
*A47K 10/18* (2006.01)
(Continued)

(52) U.S. Cl.
CPC ..... *B65D 85/62* (2013.01); *A47K 10/18* (2013.01); *B65D 71/063* (2013.01); *B65D 77/22* (2013.01); *B65D 85/67* (2013.01); *B65D 2203/00* (2013.01)

(58) Field of Classification Search
CPC ..... B65D 85/62; B65D 85/67; B65D 77/22; B65D 71/063; B65D 2203/00; A47K 10/18
(Continued)

(56) References Cited

U.S. PATENT DOCUMENTS 3,301,746 A 1/1967 Sanford et al.
3,815,519 A 6/1974 Meyer
(Continued)

FOREIGN PATENT DOCUMENTS

DE 29821626 U1 2/1999

OTHER PUBLICATIONS

Action Figure; Stretch X-Ray, Kenner, Original Box; Year: 1979, URL: http://www.prices4antiques.com/toys/action-figures/Action-Figure-Stretch-X-Ray-Kenner-Original-Box-D9953158.htm.
(Continued)

*Primary Examiner* — Ernesto A Grano
(74) *Attorney, Agent, or Firm* — Richard L. Alexander

(57) ABSTRACT

An array of toilet tissue products comprising first and second packages, where first package conveys one of strength and softness, and where the second package conveys something different than the first package. The first package may use a character to convey one of strength and softness. Lint, basis weight, total dry tensile, absorbency, and softness are common intensive properties of the first and second toilet tissue products and one or more of these common intensive properties can be different between the first and second toilet tissue products.

40 Claims, 2 Drawing Sheets

Related U.S. Application Data continuation of application No. 17/665,668, filed on Feb. 7, 2022, now Pat. No. 11,524,837, which is a continuation of application No. 17/405,086, filed on Aug. 18, 2021, now Pat. No. 11,292,660, which is a continuation of application No. 15/062,655, filed on Mar. 7, 2016, now Pat. No. 11,124,357, which is a continuation of application No. 11/897,852, filed on Aug. 31, 2007, now Pat. No. 9,327,888.

(60) Provisional application No. 60/903,170, filed on Feb. 23, 2007.

(51) Int. Cl.
*B65D 71/06* (2006.01)
*B65D 77/22* (2006.01)
*B65D 85/67* (2006.01)

(58) Field of Classification Search
USPC ..... 206/394, 391, 83.5, 139, 392, 386, 393, 206/430, 432, 442, 497, 499, 597
See application file for complete search history.

(56) References Cited

U.S. PATENT DOCUMENTS 3,877,576 A 4/1975 Kishi et al.
3,910,412 A 10/1975 Vargo
3,960,272 A 6/1976 Hartbauer et al.
3,974,025 A 8/1976 Ayers
3,994,771 A 11/1976 Morgan, Jr. et al.
4,135,024 A 1/1979 Callahan et al.
4,191,609 A 3/1980 Trokhan
4,238,541 A 12/1980 Burton
4,300,981 A 11/1981 Carstens
4,595,093 A 6/1986 Eckstein
4,637,859 A 1/1987 Trokhan
5,344,027 A 9/1994 Kaplan
5,431,786 A 7/1995 Rasch et al.
5,445,272 A 8/1995 Crisp
5,494,731 A 2/1996 Fereshtehkhou et al.
5,611,890 A 3/1997 Vinson et al.
5,685,428 A 11/1997 Herbers et al.
5,714,041 A 2/1998 Ayers et al.
5,759,346 A 6/1998 Vinson
5,814,188 A 9/1998 Vinson et al.
5,820,730 A 10/1998 Phan et al.
5,830,317 A 11/1998 Vinson et al.
5,839,585 A 11/1998 Miller
5,851,352 A 12/1998 Vinson et al.
5,961,782 A 10/1999 Luu et al.
5,972,456 A 10/1999 Esquivel
6,021,890 A 2/2000 Focke et al.
6,149,769 A 11/2000 Mohammadi et al.
6,161,795 A 12/2000 Skerrett et al.
6,162,327 A 12/2000 Batra et al.
6,162,329 A 12/2000 Vinson et al.
6,174,412 B1 1/2001 Paterson-Brown et al.
6,179,961 B1 1/2001 Ficke et al.
6,265,052 B1 7/2001 Steinhardt et al.
6,304,855 B1 10/2001 Burke
6,344,111 B1 2/2002 Wilhelm
6,354,495 B1 3/2002 Powell
D457,764 S 5/2002 Ong
6,420,013 B1 7/2002 Vinson et al.
6,440,268 B1 8/2002 Baggot et al.
6,454,095 B1 9/2002 Brisebois
6,520,330 B1 2/2003 Batra
6,547,928 B2 4/2003 Barnholtz et al.
6,551,453 B2 4/2003 Weisman et al.
6,568,530 B2 5/2003 Takahashi
6,579,416 B1 6/2003 Vinson et al.
6,601,705 B2 8/2003 Molina
6,607,637 B1 8/2003 Vinson et al.
6,613,193 B2 9/2003 Wolkowicz et al.
6,648,864 B2 11/2003 Ronn
6,702,923 B1 3/2004 Gorzynski et al.
6,821,387 B2 11/2004 Hu
6,888,044 B2 5/2005 Fell et al.
6,893,535 B2 5/2005 Hermans et al.
6,966,971 B1 11/2005 Sellars et al.
7,029,121 B2 4/2006 Edwards
7,163,732 B2 1/2007 Hirasawa et al.
7,172,073 B2 2/2007 Hanson
7,208,429 B2 4/2007 Vinson et al.
7,300,544 B2 11/2007 Hirasawa
7,326,322 B2 2/2008 Ruthven et al.
7,428,966 B2 9/2008 Goodall et al.
7,621,397 B2 11/2009 Boudrie et al.
7,803,249 B2 9/2010 Dyer et al.
8,662,301 B2 3/2014 Duval et al.
9,242,775 B2 1/2016 Knobloch et al.
9,327,888 B2 5/2016 Knobloch et al.
11,124,356 B2 9/2021 Knobloch et al.
11,124,357 B2 9/2021 Knobloch et al.
11,130,624 B2 9/2021 Knobloch et al.
11,292,660 B2 4/2022 Knobloch et al.
11,524,837 B2 12/2022 Knobloch et al.
2002/0143311 A1 10/2002 Brisebois
2002/0148749 A1 10/2002 Briseboi et al.
2003/0041496 A1 3/2003 Hagen et al.
2003/0127351 A1 7/2003 Takahashi et al.
2003/0131960 A1 7/2003 Mcconnell et al.
2003/0201085 A1 10/2003 Vinson et al.
2003/0234199 A1 12/2003 Morita et al.
2004/0059310 A1 3/2004 Gagliardi et al.
2004/0071758 A1 4/2004 Von et al.
2004/0099389 A1 5/2004 Chen et al.
2004/0101704 A1 5/2004 Hermans et al.
2004/0118530 A1 6/2004 Kressner et al.
2004/0163781 A1 8/2004 Hernandez-Munoa et al.
2004/0200752 A1 10/2004 Poli
2005/0033630 A1 2/2005 Kowalchuk
2005/0045295 A1 3/2005 Goulet et al.
2005/0065492 A1 3/2005 Cole
2005/0074483 A1 4/2005 Lange
2005/0121347 A1 6/2005 Hanson
2005/0173281 A1 8/2005 Goodall et al.
2005/0263353 A1 12/2005 Jennings
2005/0279579 A1 12/2005 Milk
2006/0014884 A1 1/2006 Goulet et al.
2006/0069372 A1 3/2006 Chakravarty
2006/0113049 A1 6/2006 Knobloch et al.
2006/0121207 A1 6/2006 Prodoehl et al.
2006/0121278 A1 6/2006 Vinson et al.
2006/0121814 A1 6/2006 Vinson et al.
2006/0134384 A1 6/2006 Vinson et al.
2006/0167425 A1 7/2006 Stellbrink et al.
2006/0168914 A1 8/2006 Steeves-Kiss
2006/0173734 A1 8/2006 Brandt
2006/0195357 A1 8/2006 Klofta
2006/0271427 A1 11/2006 Raimondo
2006/0288619 A1 12/2006 Henke et al.
2007/0043615 A1 2/2007 Dahleh et al.
2007/0055573 A1 3/2007 Grell
2007/0061188 A1 3/2007 Sakemiller et al.
2007/0077841 A1 4/2007 Zoch et al.
2007/0095706 A1 5/2007 Legault et al.
2007/0100692 A1 5/2007 Minifie et al.
2007/0156515 A1 7/2007 Hasselback et al.
2008/0051750 A1 2/2008 Schagen et al.
2008/0078685 A1 4/2008 Patterson et al.
2008/0097364 A1 4/2008 Yang
2008/0202549 A1 8/2008 Weiss
2008/0202965 A1 8/2008 Duval et al.
2008/0202968 A1 8/2008 Knobloch et al.
2008/0245491 A1 10/2008 Knobloch
2008/0245693 A1 10/2008 Vinson
2008/0247967 A1 10/2008 Sagel
2008/0247968 A1 10/2008 Sagel
2009/0056891 A1 3/2009 Wiwi et al.
2009/0057171 A1 3/2009 Roetker et al.
2016/0229606 A1 8/2016 Steeves-Kiss et al.

(56) References Cited

U.S. PATENT DOCUMENTS

| | | | |
|---|---|---|---|
| 2016/0229607 | A1 | 8/2016 | Steeves-Kiss et al. |
| 2016/0229608 | A1 | 8/2016 | Steeves-Kiss et al. |
| 2016/0229609 | A1 | 8/2016 | Steeves-Kiss et al. |
| 2020/0130910 | A1 | 4/2020 | Steeves-Kiss et al. |
| 2023/0078053 | A1 | 3/2023 | Knobloch et al. |

OTHER PUBLICATIONS

All Office Actions; U.S. Appl. No. 11/344,331, filed on Jan. 31, 2006.
All Office Actions; U.S. Appl. No. 11/897,766, filed on Aug. 31, 2007.
All Office Actions; U.S. Appl. No. 11/897,767, filed on Aug. 31, 2007.
All Office Actions; U.S. Appl. No. 11/897,768, filed on Aug. 31, 2007.
All Office Actions; U.S. Appl. No. 11/897,777, filed on Aug. 31, 2007.
All Office Actions; U.S. Appl. No. 11/897,806, filed on Aug. 31, 2007.
All Office Actions; U.S. Appl. No. 11/897,852, filed on Aug. 31, 2007.
All Office Actions; U.S. Appl. No. 11/899,227, filed on Sep. 5, 2007.
All Office Actions; U.S. Appl. No. 12/061,816, filed on Apr. 3, 2008.
All Office Actions; U.S. Appl. No. 15/062,643, filed on Mar. 7, 2016.
All Office Actions; U.S. Appl. No. 15/062,648, filed on Mar. 7, 2016.
All Office Actions; U.S. Appl. No. 15/062,655, filed on Mar. 7, 2016.
All Office Actions; U.S. Appl. No. 15/132,440, filed on Apr. 19, 2016.
All Office Actions; U.S. Appl. No. 15/132,444, filed on Apr. 19, 2016.
All Office Actions; U.S. Appl. No. 15/132,449, filed on Apr. 19, 2016.
All Office Actions; U.S. Appl. No. 15/132,456, filed on Apr. 19, 2016.
All Office Actions; U.S. Appl. No. 16/727,138, filed on Dec. 26, 2019.
All Office Actions; U.S. Appl. No. 17/405,086, filed on Aug. 18, 2021.
All Office Actions; U.S. Appl. No. 17/665,668, filed on Feb. 7, 2022.
All Office Actions; U.S. Appl. No. 18/049,693, filed on Oct. 26, 2022.
Brawny, Paper Towels, Pick-a-Size Big Roll, Jan. 1, 2005, URL: http://web.archive.org/web/2005 05 06071433/http://www. drug-store. com/.
Cashmere, Premium quality bathroom tissue, Jan. 1, 2006, URL: http//web.archive.org/web/20061027025443/cashmere.ca/index.php.
Charmin, Bathroom Tissue, Ultra, Double Roll, Jan. 1, 2005, Angel Soft, Unscented Bathroom Tissue, Jan. 10, 2005, URL: http://web.archive.org.web/2005067/http://www.drugstore.com/.
K, (c) 2001-2010 http://www.kimberly-clark.com/ourbrands/consumer_brands.aspx.
Md, Toilet Paper, 1940's/1950's, URL: http://pzrservices.typepad.com/vintageadvertising/vintage racist advertising/.
Package of Charmin (I-ply) marketed approximately 2004 by the Procter & Gamble Company.
Package of Charmin Ultra (2-ply) marketed approximately 2004 by the Procter & Gamble Company.
The History of Charmin toilet paper https://www.charmin.com/en-us/about-us/charmin-history (Year: 1990).
The Impact of Ad Background color on Brand Personality and Brand Preferences; LuzM. Gonzalez; May 2006.
Vintage Northern Facial Tissues (toilet paper roll 1950) URL: https://www.worthpoint.com/worthopedia/vintage-toilet-tissue-paper-advertising-northern (Year: 1950).
Vintage toilet paper aisle photo (80's-90's) (Year: 1980).

ARRAY OF SANITARY TISSUE PRODUCTS

CROSS REFERENCE TO RELATED APPLICATIONS

This application is a continuation of, and claims priority under 35 U.S.C. § 120 to, U.S. patent application Ser. No. 18/049,693, filed on Oct. 26, 2022, which is a continuation of U.S. patent application Ser. No. 17/665,668, filed on Feb. 7, 2022, now U.S. Pat. No. 11,524,837, issued Dec. 13, 2022, which is a continuation of U.S. patent application Ser. No. 17/405,086, filed on Aug. 18, 2021, now granted U.S. Pat. No. 11,292,660 issued on Mar. 16, 2022, which is a continuation of U.S. patent application Ser. No. 15/062,655, filed on Mar. 7, 2016, now granted U.S. Pat. No. 11,124,357, issued on Sep. 21, 2021, which is a continuation of U.S. patent application Ser. No. 11/897,852, filed on Aug. 31, 2007, now U.S. Pat. No. 9,327,888, granted May 3, 2016, which claims the benefit, under 35 USC § 119(e), of U.S. Provisional Patent Application Ser. No. 60/903,170, filed on Feb. 23, 2007, the entire disclosures of which are fully incorporated by reference herein.

FIELD OF THE INVENTION

The present invention relates to sanitary tissue products, for example toilet tissue products, packages housing such sanitary tissue products and arrays thereof wherein the sanitary tissue products and/or packages are associated with non-textual indicia that are psychologically matched to intensive properties of the sanitary tissue products; processes for making such sanitary tissue products, and marketing articles associated with displaying and/or advertising such sanitary tissue products.

BACKGROUND OF THE INVENTION

In the past, consumers of sanitary tissue products, for example toilet tissue products, have had the opportunity to purchase sanitary tissue products that exhibit similar common intensive property values but have differed in physical form and/or additives contained within such sanitary tissue products. For example, sanitary tissue products are currently offered in physical forms that vary by number of plies, most often one-ply or two-ply. In addition, some currently marketed sanitary tissue products contain additives, such as lotion. For example, Charmin® brand toilet tissue products currently are marketed in two-ply and one-ply physical forms. The two-ply physical form is marketed under the name Charmin® Ultra. The Charmin® Ultra toilet tissue product is housed within a package comprising the color blue. The one-ply physical form is marketed under the name Charmin®, Charmin® Plus, Charmin® Scents and Charmin® Basic. The Charmin® toilet tissue product is housed within a package comprising the color red and the Charmin® Plus toilet tissue product is housed within a package comprising the color green. In addition, the package comprises blue, whereas its one-ply physical form is marketed under the name Charmin® and/or Charmin® Plus and/or Charmin® Scents.

It is believed that different consumers of sanitary tissue products, especially consumers of sanitary toilet tissue products, desire different common intensive property values in the sanitary tissue products that they may select from for purchase and subsequent use. However, conventional product and marketing strategies utilized by producers of these products fail to satisfy the consumers' desires.

Further, it has been quite time consuming and confusing for consumers to determine what intensive properties, especially what dominant intensive properties a sanitary tissue product exhibits when the consumer is viewing the sanitary tissue products as they are displayed on a store shelf at the time the consumer is making a purchasing decision.

Furthermore, it is believed that the longer it takes for a consumer to identify a product on the store shelf, the less likely they will be to select and evaluate their intended product for subsequent purchase while in the store. This delay time in identifying the appropriate product on the store shelf can affect both initial purchase and/or repurchase intent of a particular product, even if the consumer has used and liked the performance of the product in the past.

Accordingly, there is a need for sanitary tissue products, for example toilet tissue products, that are associated with non-textual indicia that are psychologically matched to intensive properties of the sanitary tissue products, which may simplify and/or expedite a sanitary tissue product consumer's identification and/or selection process of sanitary tissue products on a store shelf and thus, reduce consumer confusion, shopping time and/or overall dissatisfaction with the shopping process, processes for making such sanitary tissue products, and marketing articles associated with displaying or advertising such sanitary tissue products.

DETAILED DESCRIPTION OF THE INVENTION

Definitions

Figure 1:
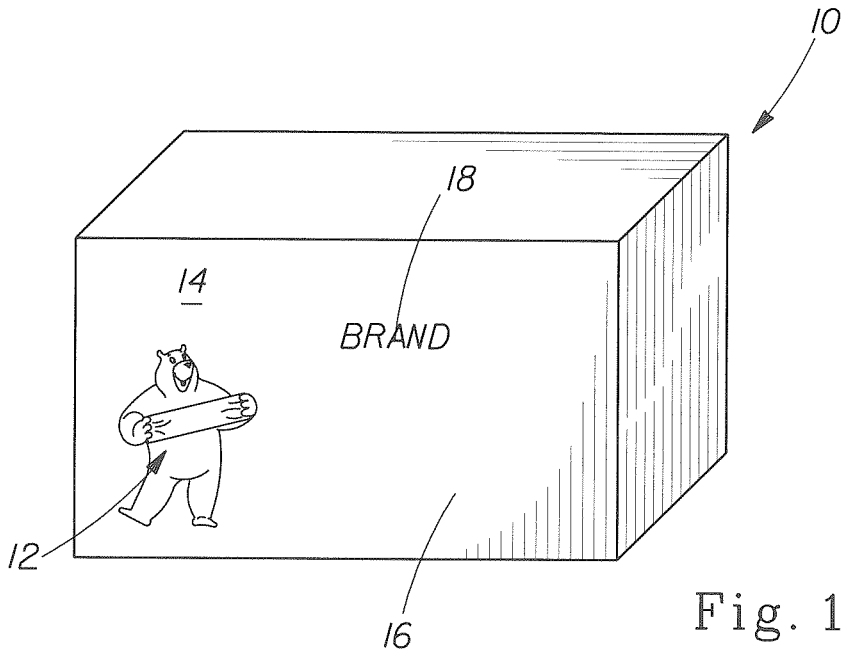
FIG. 1 is a schematic illustration of a sanitary tissue product according to the present invention.

"Fiber" as used herein means an elongate particulate having an apparent length greatly exceeding its apparent diameter, i.e. a length to diameter ratio of at least about 10. Fibers having a non-circular cross-section are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, natural fibers, including wood fibers, or synthetic fibers made from natural polymers and/or synthetic fibers, or any other suitable fibers, and any combination thereof.

"Fibrous structure" as used herein means a structure (web) that comprises one or more fibers. Nonlimiting examples of processes for making fibrous structures include known wet-laid fibrous structure making processes, air-laid fibrous structure making processes, meltblowing fibrous structure making processes, co-forming fibrous structure making processes, and spunbond fibrous structure making processes. Such processes typically include steps of preparing a fiber composition, oftentimes referred to as a fiber slurry in wet-laid processes, either wet or dry, and then depositing a plurality of fibers onto a forming wire or belt such that an embryonic fibrous structure is formed, drying and/or bonding the fibers together such that a fibrous structure is formed, and/or further processing the fibrous structure such that a finished fibrous structure is formed. The fibrous structure may be a through-air-dried fibrous structure and/or conventionally dried fibrous structure. The fibrous structure may be creped or uncreped. The fibrous structure may exhibit differential density regions or may be substantially uniform in density. The fibrous structure may be pattern densified, conventionally felt-presses and/or high-bulk, uncompacted. The fibrous structures may be homogenous or multilayered in construction.

After and/or concurrently with the forming of the fibrous structure, the fibrous structure may be subjected to physical transformation operations such as embossing, calendering, selfing, printing, folding, softening, ring-rolling, applying additives, such as latex, lotion and softening agents, combining with one or more other plies of fibrous structures, and the like to produce a finished fibrous structure that forms and/or is incorporated into a sanitary tissue product.

"Sanitary tissue product" as used herein means a wiping implement for post-urinary and/or post-bowel movement cleaning (toilet tissue product), for otorhinolaryngological discharges (facial tissue product) and/or multi-functional absorbent and cleaning uses (absorbent towel products such as paper towel products and/or wipe products).

The sanitary tissue products of the present invention may comprise one or more fibrous structures and/or finished fibrous structures.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in). Two or more sanitary tissue products within an array of sanitary tissue products according to the present invention may exhibit different total dry tensile strengths.

In one example, one sanitary tissue product in an array of sanitary tissue products according to the present invention exhibits a total dry tensile strength of greater than 216 g/cm (550 g/in) and another sanitary tissue product within the array exhibits a total dry tensile strength of less than 216 g/cm (550 g/in).

In another example, the sanitary tissue products of the present invention may exhibit a total dry tensile strength of greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit a total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit a density of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may be in any suitable form, such as in a roll, in individual sheets, in connected, but perforated sheets, in a folded format or even in an unfolded.

The sanitary tissue products of the present invention may comprises additives such as softening agents, temporary wet strength agents, permanent wet strength agents, bulk softening agents, lotions, silicones, and other types of additives suitable for inclusion in and/or on sanitary tissue products. In one example, the sanitary tissue product, for example a toilet tissue product, comprises a temporary wet strength resin. In another example, the sanitary tissue product, for example an absorbent towel product, comprises a permanent wet strength resin.

"Array of sanitary tissue products" as used herein means a group of sanitary tissue products that provide a similar benefit to a consumer. In other words, an array of sanitary tissue products includes a group of sanitary tissue products within a category such as paper towels, toilet tissue, facial tissue, wipes. In one case, such a group of sanitary tissue products includes those sanitary tissue products that reside on the same shelf in a retail store and/or in the same aisle in a retail store. For example, toilet tissue products are an array of sanitary tissue products, as are paper towel products.

"Ply" or "plies" as used herein means an individual finished fibrous structure optionally to be disposed in a substantially contiguous, face-to-face relationship with other plies, forming a multiple ply ("multi-ply") sanitary tissue product. It is also contemplated that a single-ply sanitary tissue product can effectively form two "plies" or multiple "plies", for example, by being folded on itself.

"Machine Direction" or "MD" as used herein means the direction parallel to the flow of the fibrous structure through the papermaking machine and/or product manufacturing equipment. In one example, once incorporated into a sanitary tissue product, the MD of the fibrous structure may be the MD of the sanitary tissue product.

"Cross Machine Direction" or "CD" as used herein means the direction perpendicular to the machine direction in the same plane of the fibrous structure. In one example, once incorporated into a sanitary tissue product, the CD of the fibrous structure may be the CD of the sanitary tissue product.

"Intensive property" as used herein means a property of a fibrous structure and/or sanitary tissue product, wherein the property is selected from the group consisting of: lint, softness, basis weight, texture, tensile strength, especially total dry tensile strength, absorbency and mixtures thereof.

"Common intensive property" as used herein means an intensive property that is present in two or more fibrous structures and/or sanitary tissue products.

"Value of a common intensive property" as used herein means a measured value of a common intensive property present in each of two or more fibrous structures and/or sanitary tissue products.

"Dominant common intensive property" as used herein means the greatest of two or more values of a common intensive property. For example, if one sanitary tissue product exhibits a total dry tensile strength of about 650 g/in and another sanitary tissue product exhibits a total dry tensile strength of about 500 g/in, then the dominant common intensive property is the 650 g/in and the sanitary tissue product that exhibits a total dry tensile strength of about 650 g/in exhibits the dominant common intensive property. In other words, one of the sanitary tissue products exhibits greater total dry tensile strength than the other sanitary tissue product. In one example, in order for a common intensive property of one sanitary tissue product to be a dominant common intensive property compared to another sanitary tissue product, the difference in the values of the common intensive properties of the sanitary tissue products has to be greater than about 5% and/or greater than about 10% and/or greater than about 15% and/or greater than about 20% and/or greater than about 25% and/or greater than about 30% and/or greater than about 50%.

In another example, if one sanitary tissue product exhibits a softness of about 0 psu and another sanitary tissue product exhibits a softness of +0.5 psu then the sanitary tissue product that exhibits a softness of about +0.5 psu exhibits the dominant common intensive property; namely softness. In other words, one of the sanitary tissue products is softer than the other sanitary tissue product. Relative values between sanitary tissue products, such as one sanitary tissue product is softer than another sanitary tissue product may be used to identify the dominant common intensive property in addition to the absolute values of common intensive properties.

"Relative value of a common intensive property" as used herein means the value of a common intensive property of one fibrous structure and/or sanitary tissue product compared to the value of the common intensive property in another fibrous structure and/or sanitary tissue product. For example, the value of a common intensive property of one fibrous structure and/or sanitary tissue product may be greater or less than the value of the common intensive property of another fibrous structure and/or sanitary tissue product.

"Communicated" as used herein means a package, for example a sanitary tissue product package, comprising a non-textual indicia, and/or a sanitary tissue product, itself, conveys information to a consumer about a product housed within the package. In one example, the information about the product may be conveyed intuitively to a consumer by a non-textual indicia.

"Intuitively communicated" as used herein means a package and/or sanitary tissue product, itself, comprising a non-textual indicia, conveys information by the non-textual indicia that a consumer interprets based on the consumer's previous life experiences and/or knowledge.

"Indicia" as used herein means an identifier and/or indicator and/or hint and/or suggestion, of the nature of a property of something, such as an intensive property of a sanitary tissue product.

"Textual indicia" as used herein means a text indicia, such as a word and/or phrase that communicates to a consumer a property about the sanitary tissue product it is associated with. In one example, a sanitary tissue product, such as a toilet tissue product, is housed in a package comprising a textual indicia; namely, the word "Strong."

"Brand name" as used herein means a single source identifier, in other words, a brand name identifies a product and/or service as exclusively coming from a single commercial source (i.e., company). An example of a brand name is Charmin®, which is also a trademark. Brand names are nonlimiting examples of textual indicia. The sanitary tissue products of the present invention may be marketed and/or packaged under a common brand name (i.e., the same brand name, such as Charmin®). In addition to the brand name, a product descriptor may also be associated with the sanitary tissue products, such as "Ultra Strong" and/or "Ultra Soft" for example).

"Non-textual indicia" as used herein means a non-text indicia that communicates to a consumer through a consumer's senses. In one example, a non-textual indicia may communicate, even intuitively communicate, to a consumer through sight (visual indicia), through touch (texture indicia), sound (audio indicia) and/or through smell (scent indicia).

Nonlimiting examples of non-textual indicia include colors, textures, patterns, such as emboss patterns and/or emboss pattern images or images of patterns, character representations, for example character representations exhibiting an active pose, and mixture thereof.

"Character representation" as used herein means an image of a person, animal, deity, angel or one or more parts thereof. Non-limiting examples of character representations include babies, children, females, queens, elderly ladies, officer workers, males, burly men, lumberjacks, mechanics, bears, dogs, puppies, cats, kittens, rabbits, pigs, sheep, horses, fish, cows, elephants, monkeys, lions, parts thereof such as hands, paws, teeth, hoofs, claws and mixtures thereof. In addition, the character representations may include inanimate objects such as clouds, flowers, toilets, sinks, dishes, bubbles, windows, countertops, floors and mixtures thereof.

"Active pose" as used herein means that the character representation communicates action or motion to a consumer. Non-limiting examples of active poses include stretching a sanitary tissue product between two hands of the character, wringing a sanitary tissue product by two hands, a character squeezing a sanitary tissue product and a character contacting the character's skin with a sanitary tissue product. Character representations that do not exhibit an active pose, such as a character simply standing, are not within the scope of the present invention. However, they can be present on a package so long as a character representation exhibiting an active pose is also present on the package. In one example, a character representation or part(s) thereof, such as hands, squeeze a sanitary tissue product and/or stretch a sanitary tissue product and/or hold a sanitary tissue product up to the character representation's skin. For purposes of the character representation discussion herein, the sanitary tissue product is a representation of a sanitary tissue product.

"Psychologically matched" as used herein means that a non-textual indicia on a package housing a sanitary tissue product of the present invention and/or on the sanitary tissue product, itself, denotes (i.e., serves as a symbol for; signifies; represents something) an intensive property of the sanitary tissue product. For example, the color red typically denotes strength, the color blue typically denotes softness, the color pink typically denotes softness and the color green typically denotes absorbency. Therefore, a consumer of sanitary tissue products can identify and/or select a package of sanitary tissue product that exhibits a dominant common intensive property of strength, wherein the package comprises a non-textual indicia psychologically matched (such as the color red) to communicate to the consumer that the sanitary tissue products exhibits strength as its dominant common intensive property. The psychologically matched non-textual indicia aids in mitigating any confusion that the consumer may have when trying to identify and/or select a desired sanitary tissue product among an array of sanitary tissue products. The consumer is able to interpret the intuitive communication from the non-textual indicia to be consistent with the actual dominant intensive property of the sanitary tissue product.

"Psychologically different" as used herein means that two or more different non-textual indicia, such as the color blue and the color red, denote different intensive properties. For example, the color blue denotes softness whereas the color red denotes strength. In one example, in order to be psychologically different, the non-textual indicia cannot denote the same intensive property. For example, the color blue, which denotes softness, and the color pink, which denotes softness, are not psychologically different for the purposes of the present invention. Likewise, the color blue, which denotes softness, and the color purple, which typically denotes softness, are not psychologically different for the purposes of the present invention.

"Basis Weight" as used herein is the weight per unit area of a sample reported in lbs/3000 $ft^2$ or $g/m^2$. The basis weight is measured herein by the basis weight test method described in the Test Methods section herein.

"Dry Tensile Strength" (or simply "Tensile Strength" as used herein) of a fibrous structure of the present invention and/or a sanitary tissue product comprising such fibrous structure is measured according to the Tensile Strength Test Method described herein.

"Softness" as used herein means the softness of a fibrous structure according to the present invention and/or a sanitary tissue product comprising such fibrous structure, which is determined according to a human panel evaluation wherein the softness of a test product is measured versus the softness of a control or standard product. The resulting number is a relative measure of softness between the two fibrous structures and/or sanitary tissue products. The softness is measured herein by the softness test method described in the Test Methods section herein.

"Absorbency" as used herein means the characteristic of a fibrous structure according to the present invention and/or a sanitary tissue product comprising such fibrous structure, which allows it to take up and retain fluids, particularly water and aqueous solutions and suspensions. In evaluating the absorbency of paper, not only is the absolute quantity of fluid a given amount of paper will hold significant, but the rate at which the paper will absorb the fluid is also. Absorbency is measured herein by the Horizontal Full Sheet (HFS) test method described in the Test Methods section herein.

"Lint" as used herein means any material that originated from a fibrous structure according to the present invention and/or sanitary tissue product comprising such fibrous structure that remains on a surface after which the fibrous structure and/or sanitary tissue product has come into contact. The lint value of a fibrous structure and/or sanitary tissue product comprising such fibrous structure is determined according to the Lint Test Method described herein.

"Texture" as used herein means any pattern present in the fibrous structure. For example, a pattern may be imparted to the fibrous structure during the fibrous structure-making process, such as during a through-air-drying step. A pattern may also be imparted to the fibrous structure by embossing the finished fibrous structure during the converting process and/or by any other suitable process known in the art.

"Color" as used herein, means a visual effect resulting from a human eye's ability to distinguish the different wavelengths or frequencies of light. The apparent color of an object depends on the wavelength of the light that it reflects. While a wide palette of colors can be employed herein, it is preferred to use a member selected from the group consisting of orange, purple, lavender, red, green, blue, yellow, and violet. The method for measuring color is described in the Color Test Method described herein.

Sanitary Tissue Product and Package

A sanitary tissue product according to the present invention may be housed within a package comprising a non-textual indicia.

As shown in FIG. 1, in one example, a sanitary tissue product package 10 for housing a sanitary tissue product (not shown) comprises a non-textual indicia 12; namely, a character representation exhibiting an active pose, in this example it is a bear stretching a sanitary tissue product, that is psychologically matched to an intensive property exhibited by a sanitary tissue product to be housed in the package 10. The non-textual indicia 12 may be on a surface 14 of the package 10.

The package 10 may be made from any suitable packaging material 16 known in the art. Nonlimiting examples include polywrap, polymer films, such as polyolefin films, polyester films, paper, cardboard, plastic, wood, metal and other suitable packaging materials. In one example, the package 10 comprises a polyolefin film. In another example, the package 10 comprises a polyester film. In still another example, the package 10 comprises cardboard. Nonlimiting examples of packages suitable for use with the sanitary tissue products of the present invention are commercially available from Cello-Foil Products, Inc. and Superpac. In one example, non-textual indicia, such as colors, are applied to and/or made a part of film that forms the package by any suitable application process known in the art.

In addition to the non-textual indicia 12, the package 10 may further comprise a single source identifier, such as a brand name, 18, such as a trademark, as represented by "BRAND" in FIG. 1. The single source identifier 18 may be positioned entirely or partially within the non-textual indicia 12. In another example, the single source identifier 18 may be discrete from the non-textual indicia 12.

Figure 2:
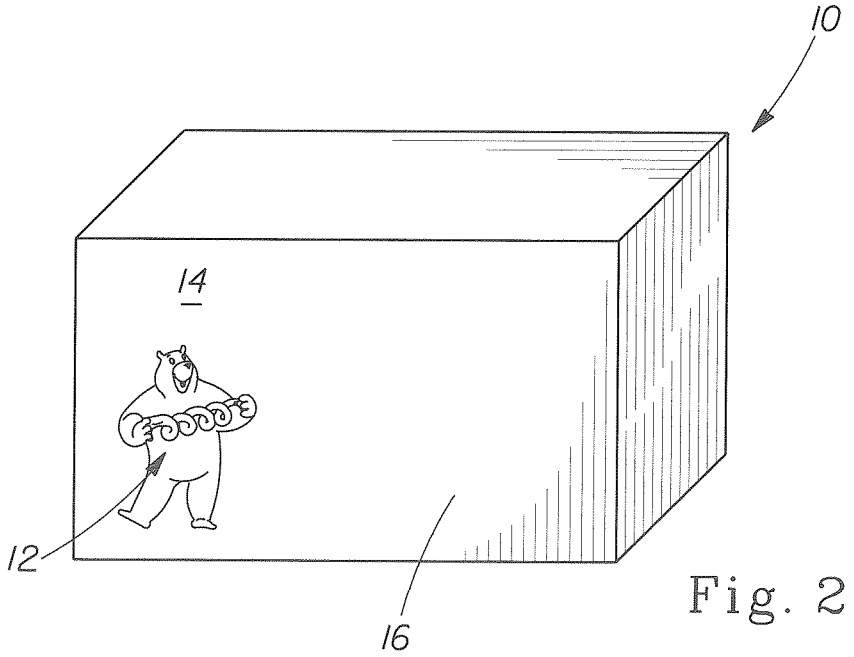
FIG. 2 is a schematic illustration of another sanitary tissue product according to the present invention.

As shown in FIG. 2, in another example, a sanitary tissue product package 10 for housing a sanitary tissue product (not shown) comprises a non-textual indicia 12; namely, a character representation exhibiting an active pose, in this example it is a pair of hands that are wringing a sanitary tissue product, that is psychologically matched to an intensive property exhibited by a sanitary tissue product to be housed in the package 10. The non-textual indicia 12 may be on a surface 14 of the package 10.

Figure 3:
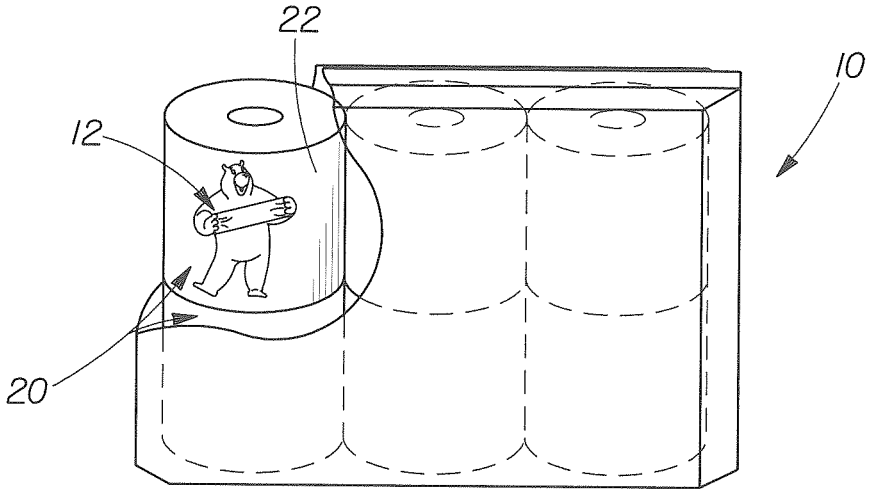
FIG. 3 is a schematic illustration of another sanitary tissue product according to the present invention.

As shown in FIG. 3, in another example, a package 10 for housing a sanitary tissue product 20 may be made such that a surface 22 of the sanitary tissue product 20 housed within the package 10 is visible to a consumer at the point of sale and/or in advertising. The sanitary tissue product 20 may comprise a non-textual indicia 12, for example a character representation, that is psychologically matched to an intensive property of the sanitary tissue product 20.

Array of Sanitary Tissue Products

An array of sanitary tissue products according to the present invention may comprise two or more sanitary tissue products.

Figure 4:
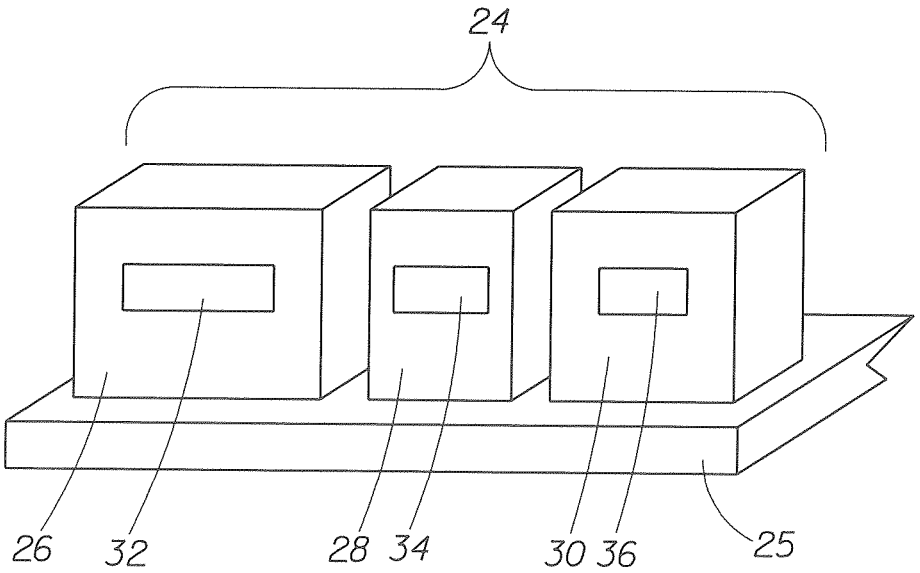
FIG. 4 is an array of sanitary tissue products according to the present invention.

As shown in FIG. 4, in one example, an array of sanitary tissue products 24 (displayed on a store shelf 25 for example) housed within different packages 26, 28, 30. The first sanitary tissue product housed within the first package 26 exhibits a value of a common intensive property that is different from the second sanitary tissue product housed within the second package 28. In one example, the first sanitary tissue product's value of the common intensive property is the dominant common intensive property. The relative value of the common intensive property of the first sanitary tissue product compared to the second sanitary tissue product is communicated to a consumer of sanitary tissue products by non-textual indicia 32, 34. The non-textual indicia 32 may be psychologically matched to a dominant common intensive property present in the first sanitary tissue product. The non-textual indicia 34 may be psychologically matched to a dominant common intensive property present in the second sanitary tissue product. In one example, the non-textual indicia 32 is psychologically different from the non-textual indicia 34.

In addition to the first and second sanitary tissue products within the array, the array may further comprise a third sanitary tissue product. The third sanitary tissue product may exhibit a value of a common intensive property that is the same and/or different from the value of the common intensive property in the first sanitary tissue product and the second sanitary tissue product. The third sanitary tissue product may be housed within a package 30 that comprises a non-textual indicia 36. The non-textual indicia 36 may be psychologically matched to an intensive property of the third sanitary tissue product. Further, the non-textual indicia 36 may be psychologically different from one or both non-textual indicia 32, 34.

In addition to non-textual indicia, the packages comprising the sanitary tissue products may further comprise textual indicia. Nonlimiting examples of textual indicia include text, such as brand names, which may be the same, separate, independent product designations that reinforce and/or support the non-textual indicia present on the packages.

In one example, a package comprising a sanitary tissue product may comprise information about at least one or more, and/or two or more different sanitary tissue products within the array of sanitary tissue products.

In another example, a package comprising a sanitary tissue product may comprise information about various roll sizes in which the sanitary tissue product within the package is available to the consumer.

In one example, an array of sanitary tissue products in accordance with the present invention may comprise a plurality of single- and/or multi-ply sanitary tissue products. The sanitary tissue products may be dry and/or wet. The sanitary tissue products may come in a variety of roll sizes and may be packaged in different numbers, such as four, six, nine, twenty-four, and the like. The array of sanitary tissue products may displayed on a shelf at a point of sale, such as within a retail store, in such as way that the different sanitary tissue products within the array are visible to a consumer during the consumer's purchasing decision process.

The array of sanitary tissue products of the present invention may comprise two or more multi-ply sanitary tissue products, such as two or more two-ply sanitary tissue products. The array may comprise at least one single-ply sanitary tissue product. The array may comprise a mixture of single-ply and multi-ply sanitary tissue products.

The array of sanitary tissue products may comprise two or more sanitary tissue products each of which comprises at least one value of a common intensive property that is different from at least one or more of the others.

The array of sanitary tissue products may comprise a single-ply sanitary tissue product that comprises at least one value of a common intensive property that is different from at least one multi-ply sanitary tissue product within the array of sanitary tissue products.

The array of sanitary tissue products may comprises a single-ply sanitary tissue product that comprises at least one value of a common intensive property that is different from the two or more multi-ply sanitary tissue products within the array of sanitary tissue products.

The array of sanitary tissue products may comprise two or more single-ply sanitary tissue products each of which comprises at least one value of a common intensive property that is different from at least one or more of the others.

Two or more sanitary tissue products within an array of sanitary tissue products may differ in price, for example differ in retail price to a consumer.

In addition to the sanitary tissue product packages comprising non-textual indicia, marketing articles such as in-store ads, in-store flyers, print ads, periodical ads, billboards, end-of-aisle displays, pallet wrappers, secondary packaging, corrugated boxes, shrink-wrap packaging, floor ads, window stick-on ads, shelf talkers, internet sites, etc. associated with the sanitary tissue products may also comprise non-textual indicia. The non-textual indicia on the marketing articles may be psychologically matched to intensive properties within the sanitary tissue products that the marketing articles are associated with. Further, the non-textual indicia on the marketing articles may be psychologically different. In one example, a marketing article, such as a billboard, comprises two non-textual indicia that are psychologically different and are psychologically matched to two different common intensive properties within two different sanitary tissue products.

Process for Displaying an Array of Sanitary Tissue Products

The array of sanitary tissue products in accordance with the present invention may be displayed by any suitable process and any suitable location, such as a retail store, for a consumer's viewing, identification, selection and/or purchasing.

Intuitive Communication

Non-limiting examples of non-textual, intuitive communication methods include: hand gestures and movements; stick figures or other animated characters demonstrating action; traffic sign shapes, lights, and arrows, body postures, facial expressions, eye movement, use of patterns, lines, curves, colors, etc. The human brain interprets these modes of non-textual, intuitive communication based on prior experiences, instinct, emotions and/or feelings that are generated within the human brain when it is exposed to these forms of non-textual, intuitive communication. Psychologists have spent many years developing an understanding of how the human brain interprets these modes of communication and how they support, speed-up and/or redefine interpretation of verbal and/or written communication. In the present invention, several modes of non-textual, intuitive communication may be used to speed up consumers' interpretation of written communication on a package, thereby reducing the time necessary for consumers to identify, evaluate, and select for purchase an intended sanitary tissue product within an array of sanitary tissue products.

Non-Textual Character Representation Communication

In one example of an intuitive method of delineating intensive properties of an article of manufacture, the toilet tissue product package surface includes an animated character(s), animal(s), individual(s) demonstrating an action that consumers associate with a particular intensive property. A non-limiting list of potential action(s) could include squeezing, hugging, rubbing, wiping, bouncing, stretching, smelling, wringing, springing, twisting and combinations thereof.

Table 1 lists some of these potential actions and the intensive properties the action is intended to intuitively communicate.

TABLE 1

Intuitive Character Communication

| Action | Potential Intensive Property |
|---|---|
| Squeezing | Softness |
| Hugging | Softness, Absorbency |
| Rubbing | Softness, Absorbency |
| Wiping | Softness, Strength |
| Bouncing | Density, Basis Weight |
| Stretching | Strength |
| Smelling | Scent |
| Wringing | Strength, Absorbency, Reusability |

In addition to the active pose, the character representations may comprise a color that also psychologically matches an intensive property of the sanitary tissue product that the character representation is associated with. Further, in an array of sanitary tissue products, one character representation associated with one sanitary tissue product may comprise a first color, such as red, and a second character representation associated with another sanitary tissue product may comprise a second color different from the first, such as blue.

Test Methods

Unless otherwise indicated, all tests described herein including those described under the Definitions section and the following test methods are conducted on samples, fibrous structure samples and/or sanitary tissue product samples and/or handsheets that have been conditioned in a conditioned room at a temperature of 73° F.±4° F. (about 23° C.±2.2° C.) and a relative humidity of 50%±10% for 2 hours prior to the test. Further, all tests are conducted in such conditioned room. Tested samples and felts should be subjected to 73° F.±4° F. (about 23° C.±2.2° C.) and a relative humidity of 50%±10% for 2 hours prior to testing.

Basis Weight Method

Basis weight is measured by preparing one or more samples of a certain area ($m^2$) and weighing the sample(s) of a fibrous structure according to the present invention and/or a sanitary toilet tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$).

Dry Tensile Strength Test Method

One (1) inch by five (5) inch (2.5 cm×12.7 cm) strips of fibrous structure and/or sanitary toilet tissue product are provided. The strip is placed on an electronic tensile tester Model 1122 commercially available from Instron Corp., Canton, Massachusetts in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The Dry Tensile Strength can be measured in any direction by this method. The "Total Dry Tensile Strength" or "TDT" is the special case determined by the arithmetic total of MD and CD tensile strengths of the strips.

Wet Tensile Strength Test Method

An electronic tensile tester (Thwing-Albert EJA Materials Tester, Thwing-Albert Instrument Co., 10960 Dutton Rd., Philadelphia, Pa., 19154) is used and operated at a crosshead speed of 4.0 inch (about 10.16 cm) per minute and a gauge length of 1.0 inch (about 2.54 cm), using a strip of a fibrous structure and/or sanitary tissue product of 1 inch wide and a length greater than 3 inches long. The two ends of the strip are placed in the upper jaws of the machine, and the center of the strip is placed around a stainless steel peg (0.5 cm in diameter). After verifying that the strip is bent evenly around the steel peg, the strip is soaked in distilled water at about 20° C. for a soak time of 5 seconds before initiating cross-head movement. The initial result of the test is an array of data in the form load (grams force) versus crosshead displacement (centimeters from starting point).

The sample is tested in two orientations, referred to here as MD (machine direction, i.e., in the same direction as the continuously wound reel and forming fabric) and CD (cross-machine direction, i.e., 90° from MD). The MD and CD wet tensile strengths are determined using the above equipment and the Total Wet Tensile is determined by taking the sum of these two values.

Softness Test Method

Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;

3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

Lint Value Test Method

The amount of lint generated from a finished fibrous structure is determined with a Sutherland Rub Tester. This tester uses a motor to rub a weighted felt 5 times over the finished fibrous structure, while the finished fibrous structure is restrained in a stationary position. This finished fibrous structure can be is referred to throughout this method as the "web". The Hunter Color L value is measured before and after the rub test. The difference between these two Hunter Color L values is then used to calculate a lint value. This lint method is designed to be used with white or substantially white fibrous structures and/or sanitary toilet tissue products. Therefore, if testing of a non-white tissue, such as blue-colored or peach-colored tissue is desired, the same formulation should be used to make a sample without the colored dye, pigment, etc, using bleached kraft pulps.

i. Sample Preparation

Prior to the lint rub testing, the samples to be tested should be conditioned according to Tappi Method #T402OM-88. Here, samples are preconditioned for 24 hours at a relative humidity level of 10 to 35% and within a temperature range of 22° C. to 40° C. After this preconditioning step, samples should be conditioned for 24 hours at a relative humidity of 48 to 52% and within a temperature range of 22° C. to 24° C. This rub testing should also take place within the confines of the constant temperature and humidity room.

The Sutherland Rub Tester may be obtained from Testing Machines, Inc. (Amityville, N.Y., 1701). The web is first prepared by removing and discarding any product which might have been abraded in handling, e.g. on the outside of the roll. For products formed from multiple plies of webs, this test can be used to make a lint measurement on the multi-ply product, or, if the plies can be separated without damaging the specimen, a measurement can be taken on the individual plies making up the product. If a given sample differs from surface to surface, it is necessary to test both surfaces and average the values in order to arrive at a composite lint value. In some cases, products are made from multiple-plies of webs such that the facing-out surfaces are identical, in which case it is only necessary to test one surface. If both surfaces are to be tested, it is necessary to obtain six specimens for testing (Single surface testing only requires three specimens). Each specimen should be folded in half such that the crease is running along the cross direction (CD) of the web sample. For two-surface testing, make up 3 samples with a first surface "out" and 3 with the second-side surface "out". Keep track of which samples are first surface "out" and which are second surface out.

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.5" 6". Puncture two holes into each of the six cards by forcing the cardboard onto the hold down pins of the Sutherland Rub tester.

Center and carefully place each of the 2.5×6" cardboard pieces on top of the six previously folded samples. Make sure the 6" dimension of the cardboard is running parallel to the machine direction (MD) of each of the tissue samples. Center and carefully place each of the cardboard pieces on top of the three previously folded samples. Once again, make sure the 6" dimension of the cardboard is running parallel to the machine direction (MD) of each of the web samples.

Fold one edge of the exposed portion of the web specimen onto the back of the cardboard. Secure this edge to the cardboard with adhesive tape obtained from 3M Inc. (¾" wide Scotch Brand, St. Paul, Minn.). Carefully grasp the other over-hanging tissue edge and snugly fold it over onto the back of the cardboard. While maintaining a snug fit of the web specimen onto the board, tape this second edge to the back of the cardboard. Repeat this procedure for each sample.

Turn over each sample and tape the cross direction edge of the web specimen to the cardboard. One half of the adhesive tape should contact the web specimen while the other half is adhering to the cardboard. Repeat this procedure for each of the samples. If the tis sue sample breaks, tears, or becomes frayed at any time during the course of this sample preparation procedure, discard and make up a new sample with a new tissue sample strip.

There will now be 3 first-side surface "out" samples on cardboard and (optionally) 3 second-side surface "out" samples on cardboard.

ii. Felt Preparation

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.25"×7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent from New England Gasket, 550 Broad Street, Bristol, Conn. 06010) to the dimensions of 2.25"×8.5"×0.0625". Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard with Scotch brand tape. Prepare a total of six of these felt/cardboard combinations.

For best reproducibility, all samples should be run with the same lot of felt. Obviously, there are occasions where a single lot of felt becomes completely depleted. In those cases where a new lot of felt must be obtained, a correction factor should be determined for the new lot of felt. To determine the correction factor, obtain a representative single web sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot. Next, rub test the 24 cardboard/felt boards of the new lot and the 24 cardboard/felt boards of the old lot as described below. Make sure the same web lot number is used for each of the 24 samples for the old and new lots. In addition, sampling of the web in the preparation of the cardboard/tissue samples must be done so the new lot of felt and the old lot of felt are exposed to as representative as possible of a tissue sample. Discard any product which might have been damaged or abraded. Next, obtain 48 web samples for the calibration. Place the first sample on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "F" (for "first-side"). Mark the next highest number with the letter "S" (for second-side). Continue marking the samples in this alternating "F"/"S" pattern. Use the "F" samples for first surface "out" lint analyses and the "S" samples for second-side surface "out" lint analyses. There are now a total of 24 samples for the new lot of felt and the old lot of felt. Of this 24, twelve are for first-side surface "out" lint analysis and 12 are for second-side surface "out" lint analysis.

Rub and measure the Hunter Color L values for all 24 samples of the old felt as described below. Record the 12 first-side surface Hunter Color L values for the old felt. Average the 12 values. Record the 12 second-side surface Hunter Color L values for the old felt. Average the 12 values. Subtract the average initial un-rubbed Hunter Color L felt reading from the average Hunter Color L reading for the first-side surface rubbed samples. This is the delta average difference for the first-side surface samples. Subtract the average initial un-rubbed Hunter Color L felt reading from the average Hunter Color L reading for the second-side surface rubbed samples. This is the delta average difference for the second-side surface samples. Calculate the sum of the delta average difference for the first-side surface and the delta average difference for the second-side surface and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 first-side surface Hunter Color L values for the new felt. Average the 12 values. Record the 12 second-side surface Hunter Color L values for the new felt. Average the 12 values. Subtract the average initial un-rubbed Hunter Color L felt reading from the average Hunter Color L reading for the first-side surface rubbed samples. This is the delta average difference for the first-side surface samples. Subtract the average initial un-rubbed Hunter Color L felt reading from the average Hunter Color L reading for the second-side surface rubbed samples. This is the delta average difference for the second-side surface samples. Calculate the sum of the delta average difference for the first side surface and the delta average difference for the second-side surface and divide this sum by 2. This is the uncorrected lint value for the new felt.

Take the difference between the corrected Lint Value from the old felt and the uncorrected lint value for the new felt. This difference is the felt correction factor for the new lot of felt. Adding this felt correction factor to the uncorrected lint value for the new felt should be identical to the corrected Lint Value for the old felt. Note that the above procedure implies that the calibration is done with a two-surfaced specimen. If it desirable or necessary to do a felt calibration using a single-surfaced sample, it is satisfactory; however, the total of 24 tests should still be done for each felt.

iii. Care of 4 Pound Weight

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off. When not in use, the weight must be positioned such that the pads are not supporting the full weight of the weight. It is best to store the weight on its side.

iv. Rub Tester Instrument Calibration

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run 5 strokes by moving the pointer arm on the large dial to the "five" position setting. One stroke is a single and complete forward and reverse motion of the weight. The end of the rubbing block should be in the position closest to the operator at the beginning and at the end of each test. Prepare a test specimen on cardboard sample as described above. In addition, prepare a felt on cardboard sample as described above. Both of these samples will be used for calibration of the instrument and will not be used in the acquisition of data for the actual samples.

Place this calibration web sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the web sample and not the web sample itself. The felt must rest flat on the tissue sample and must be in 100% contact with the web surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the web sample at the beginning and end of this test, the tester is calibrated and ready to use. If the total number of strokes is not five or if the end of the felt covered weight closest to the operator is over the actual web sample either at the beginning or end of the test, repeat this calibration procedure until 5 strokes are counted the end of the felt covered weight closest to the operator is situated over the cardboard at the both the start and end of the test. During the actual testing of samples, monitor and observe the stroke count and the starting and stopping point of the felt covered weight. Recalibrate when necessary.

v. Hunter Color Meter Calibration

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary. Place the white standard plate on the sample stage under the instrument port. Release the sample stage and allow the sample plate to be raised beneath the sample port. Using the "L-Y", "a-X", and "b-Z" standardizing knobs, adjust the instrument to read the Standard White Plate Values of "L", "a", and "b" when the "L", "a", and "b" push buttons are depressed in turn.

vi. Measurement of Samples

The first step in the measurement of lint is to measure the Hunter color values of the black felt/cardboard samples prior to being rubbed on the web sample. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit. If a D25D2A head is in use, lower the felt covered cardboard and plate, rotate the felt covered cardboard 90° so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual web sample/cardboard combinations, place the web sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight Hook this weight onto the tester arm and gently place the web sample underneath the weight/felt combination. The end of the weight closest to the operator must be over the cardboard of the web sample and not the web sample itself. The felt must rest flat on the web sample and must be in 100% contact with the web surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and recalibrate as directed above in the Sutherland Rub Tester Calibration section.

Remove the weight with the felt covered cardboard. Inspect the web sample. If torn, discard the felt and web sample and start over. If the web sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples. After all web specimens have been measured, remove and discard all felt. Felts strips are not used again. Cardboards are used until they are bent, torn, limp, or no longer have a smooth surface.

vii. Calculations

Determine the delta L values by subtracting the average initial L reading found for the unused felts from each of the measured values for the first-side surface and second-side surface sides of the sample as follows.

For samples measured on both surfaces, subtract the average initial L reading found for the unused felts from each of the three first-side surface L readings and each of the three second-side surface L readings. Calculate the average delta for the three first-side surface values. Calculate the average delta for the three second-side surface values. Subtract the felt factor from each of these averages. The final results are termed a lint for the first-side surface and a lint for the second-side surface of the web.

By taking the average of the lint value on the first-side surface and the second-side surface, the lint is obtained which is applicable to that particular web or product. In other words, to calculate lint value, Formula 4 below is used:

$$\text{Lint Value} = \frac{\text{Lint Value, first-side} + \text{Lint Value, second-side}}{2} \quad \text{Formula 4}$$

For samples measured only for one surface, subtract the average initial L reading found for the unused felts from each of the three L readings. Calculate the average delta for the three surface values. Subtract the felt factor from this average. The final result is the lint value for that particular web or product.

Color Test Method

Color-containing surfaces are tested in a dry state and at an ambient humidity of approximately 500%.+—0.2%. Reflectance color is measured using the Hunter Lab LabScan XE reflectance spectrophotometer obtained from Hunter Associates Laboratory of Reston, Va. The spectrophotometer is set to the CIELab color scale and with a D50 illumination. The Observer is set at 10° and the Mode is set at 45/0°. Area View is set to 0.125" and Port Size is set to 0.20" for films; Area View is set to 1.00" and Port Size is set to 1.20" other materials. The spectrophotometer is calibrated prior to sample analysis utilizing the black and white reference tiles supplied from the vendor with the instrument. Calibration is done according to the manufacturer's instructions as set forth in LabScan XE User's Manual, Manual Version 1.1, August 2001, A60-1010-862.

If cleaning is required of the reference tiles or samples, only tissues that do not contain embossing, lotion, or brighteners should be used (e.g., Puffs® tissue). Any sample point on the externally visible surface of the element containing the imparted color to be analyzed should be selected. Sample points are selected so as to be close in perceived color. A single ply of the element is placed over the spectrophotometer's sample port. A single ply, as used within the test method, means that the externally visible surface of the element is not folded. Thus, a single ply of an externally visible surface may include the sampling of a laminate, which itself is comprised of more than one lamina. The sample point comprising the color to be analyzed must be larger than the sample port to ensure accurate measurements. A white tile, as supplied by the manufacturer, is placed behind the externally visible surface. The L*, a*, and b* values are read and recorded. The externally visible surface is removed and repositioned so that a minimum of six readings are obtained for the externally visible surface. If possible (e.g., the size of the imparted color on the element in question does not limit the ability to have six discretely different, non-overlapping sample points), each of the readings is to be performed at a substantially different region on the externally visible surface so that no two sample points overlap. If the size of the imparted color region requires overlapping of sample points, only six samples should be taken with the sample points selected to minimize overlap between any two sample points. The readings are averaged to yield the reported L*, a*, and b* values for a specified color on an externally visible surface of an element.

In calculating the color space volume, V, maximum and minimum L*, a*, and b* values are determined for a particular set of elements to be color matched. The maximum and minimum L*, a*, and b* values are used to calculate V according to Formula 2 presented above.

Absorbency Test Method (Horizontal Full Sheet (HFS))

The Horizontal Full Sheet (HFS) test method determines the amount of distilled water absorbed and retained by a sanitary toilet tissue product of the present invention. This method is performed by first weighing a sample of the sanitary toilet tissue product to be tested (referred to herein as the "Dry Weight of the paper"), then thoroughly wetting the sanitary toilet tissue product, draining the wetted sanitary toilet tissue product in a horizontal position and then reweighing (referred to herein as "Wet Weight of the paper"). The absorptive capacity of the sanitary toilet tissue product is then computed as the amount of water retained in units of grams of water absorbed by the sanitary toilet tissue product. When evaluating different sanitary toilet tissue product samples, the same size of sanitary toilet tissue product is used for all samples tested.

The apparatus for determining the HFS capacity of sanitary toilet tissue product comprises the following: an electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the sanitary toilet tissue product tested (i.e.; a paper sample of about 11 in. (27.9 cm) by 11 in. (27.9 cm)). The balance pan can be made out of a variety of materials. Plexiglass is a common material used.

A sample support rack and sample support cover is also required. Both the rack and cover are comprised of a lightweight metal frame, strung with 0.012 in. (0.305 cm) diameter monofilament so as to form a grid of 0.5 inch squares (1.27 $cm^2$). The size of the support rack and cover is such that the sample size can be conveniently placed between the two.

The HFS test is performed in an environment maintained at 23±1° C. and 50±2% relative humidity. A water reservoir or tub is filled with distilled water at 23±1° C. to a depth of 3 inches (7.6 cm).

The sanitary toilet tissue product to be tested is carefully weighed on the balance to the nearest 0.01 grams. The dry weight of the sample is reported to the nearest 0.01 grams. The empty sample support rack is placed on the balance with the special balance pan described above. The balance is then zeroed (tared). The sample is carefully placed on the sample support rack. The support rack cover is placed on top of the support rack. The sample (now sandwiched between the rack and cover) is submerged in the water reservoir. After the sample has been submerged for 60 seconds, the sample support rack and cover are gently raised out of the reservoir.

The sample, support rack and cover are allowed to drain horizontally for 120±5 seconds, taking care not to excessively shake or vibrate the sample. Next, the rack cover is carefully removed and the wet sample and the support rack are weighed on the previously tared balance. The weight is recorded to the nearest 0.01 g. This is the wet weight of the sample.

The gram per sanitary toilet tissue product sample absorptive capacity of the sample is defined as (Wet Weight of the paper−Dry Weight of the paper).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An array of toilet tissue products comprising:

a first toilet tissue product and a second toilet tissue product, wherein each of lint, basis weight, total dry tensile, absorbency, and softness are common intensive properties of the first and second toilet tissue products, the first toilet tissue product exhibiting a first lint value, a first basis weight, a first total dry tensile, a first absorbency value, and a first softness value and the second toilet tissue product exhibiting a second lint value, a second basis weight, a second total dry tensile, a second absorbency value, and a second softness value;

wherein at least one of the first lint value, the first basis weight, the first total dry tensile, the first absorbency value, and the first softness value is at least 5% different than the second lint value, the second basis weight, the second total dry tensile, the second absorbency value, and the second softness value, respectively;

wherein the first toilet tissue product is housed within a first toilet tissue product package comprising a first conveyance of at least one of strength and softness; and wherein the second toilet tissue product is housed within a second toilet tissue product package comprising a second conveyance that is different from the first conveyance;

wherein the first conveyance is in the form of a character;

wherein the first and second toilet tissue product packages are separate from each other such that the first toilet tissue product package is displayed on a store shelf separate from the second toilet tissue product package such that a consumer desiring to purchase one of the first and second toilet tissue products has the opportunity to choose one of the first and second toilet tissue products; and wherein the first and second toilet tissue product packages each comprise a common single source identifier.

2. The array of toilet tissue products of claim 1, wherein the array further comprises a third toilet tissue product package comprising a third toilet tissue product, wherein the third toilet tissue product is single-ply.

3. The array of toilet tissue products of claim 2, wherein the third toilet tissue product comprises a common intensive property that has a different value than each of the first and second toilet tissue products.

4. The array of toilet tissue products of claim 3, wherein the array further comprises a fourth toilet tissue product package comprising a fourth toilet tissue product, wherein the fourth toilet tissue product is single-ply, and wherein the fourth toilet tissue product comprises a common intensive property that has a different value than at least one of the first and second toilet tissue products.

5. The array of toilet tissue products of claim 1, wherein the common single source identifier comprises a trademark.

6. The array of toilet tissue products of claim 1, wherein the first package comprises a non-verbal cue that connotes strength.

7. The array of toilet tissue products of claim 1, wherein the second package comprises a non-verbal cue that connotes softness.

8. The array of toilet tissue products of claim 1, wherein at least one of the first and second packages further comprises a representation of a texture present on the toilet tissue product within the package.

9. The array of toilet tissue products of claim 1, wherein the first and second toilet tissue products are priced differently.

10. The array of toilet tissue products of claim 1, wherein at least one of the first and second packages further comprises information about other toilet tissue products within the array.

11. The array of toilet tissue products of claim 1, wherein at least one of the first and second packages further comprises information about various roll sizes in which the toilet tissue product within the package is available.

12. The array of toilet tissue products of claim 1, wherein the array comprises dry and wet toilet tissue products.

13. The array of toilet tissue products of claim 1, wherein at least two of the first lint value, the first basis weight, the first total dry tensile, the first absorbency value, and the first softness value is at least 5% different than the second lint value, the second basis weight, the second total dry tensile, the second absorbency value, and the second softness value, respectively.

14. The array of toilet tissue products of claim 1, wherein at least three of the first lint value, the first basis weight, the first total dry tensile, the first absorbency value, and the first softness value is at least 5% different than the second lint value, the second basis weight, the second total dry tensile, the second absorbency value, and the second softness value, respectively.

15. The array of toilet tissue products of claim 1, wherein at least one of the first lint value, the first basis weight, the first total dry tensile, the first absorbency value, and the first softness value is at least 10% different than the second lint value, the second basis weight, the second total dry tensile, the second absorbency value, and the second softness value, respectively.

16. The array of toilet tissue products of claim 1, wherein at least two of the first lint value, the first basis weight, the first total dry tensile, the first absorbency value, and the first softness value is at least 10% different than the second lint value, the second basis weight, the second total dry tensile, the second absorbency value, and the second softness value, respectively.

17. The array of toilet tissue products of claim 1, wherein at least three of the first lint value, the first basis weight, the first total dry tensile, the first absorbency value, and the first softness value is at least 10% different than the second lint value, the second basis weight, the second total dry tensile, the second absorbency value, and the second softness value, respectively.

18. The array of toilet tissue products of claim 1, wherein at least one of the first lint value, the first basis weight, the first total dry tensile, the first absorbency value, and the first softness value is at least 15% different than the second lint value, the second basis weight, the second total dry tensile, the second absorbency value, and the second softness value, respectively.

19. The array of toilet tissue products of claim 1, wherein at least two of the first lint value, the first basis weight, the first total dry tensile, the first absorbency value, and the first softness value is at least 15% different than the second lint value, the second basis weight, the second total dry tensile, the second absorbency value, and the second softness value, respectively.

20. The array of toilet tissue products of claim 1, wherein at least three of the first lint value, the first basis weight, the first total dry tensile, the first absorbency value, and the first softness value is at least 15% different than the second lint value, the second basis weight, the second total dry tensile, the second absorbency value, and the second softness value, respectively.

21. The array of toilet tissue products of claim 1, wherein the second toilet tissue product package comprises blue indicia.

22. The array of toilet tissue products of claim 1, wherein the first toilet tissue product package comprises red indicia.

23. The array of toilet tissue products of claim 1, wherein the first toilet tissue product package comprises red indicia and wherein the second toilet tissue product package comprises blue indicia.

24. The array of toilet tissue products of claim 1, wherein the first and second toilet tissue product packages are placed immediately side by side to each other in the array.

25. The array of toilet tissue products of claim 1, wherein the first and second toilet tissue product packages comprises textual indicia to convey strength and softness, respectively.

26. The array of toilet tissue products of claim 1, wherein the first toilet tissue product package comprises a first product descriptor and wherein the second toilet tissue product package comprises a second product descriptor, and wherein at least at least a portion of the first and second product descriptors are common.

27. The array of toilet tissue products of claim 1, wherein the first toilet tissue product package comprises a first product descriptor and wherein the second toilet tissue product package comprises a second product descriptor, and wherein at least at least a portion of the first and second product descriptors are different.

28. The array of toilet tissue products of claim 26, wherein each of the first and second product descriptors use the word "Ultra".

29. The array of toilet tissue products of claim 27, wherein the first toilet tissue product package product descriptor uses the word "strong" and wherein the second toilet tissue product package product descriptor uses the word "soft".

30. The array of toilet tissue products of claim 1, wherein each of the first and second toilet tissue product packages are made from paper.

31. The array of toilet tissue products of claim 1, wherein the character is in an active pose.

32. The array of toilet tissue products of claim 1, wherein the character conveys strength.

33. The array of toilet tissue products of claim 1, wherein the character conveys softness.

34. The array of toilet tissue products of claim 1, wherein the first conveyance is in the form of a first character that conveys strength and wherein the second conveyance is in the form of a second character that conveys softness.

35. The array of toilet tissue products of claim 34, wherein the first and second characters are selected from the group consisting of people, animals, deities, angels, and combinations thereof.

36. The array of toilet tissue products of claim 34, wherein the first and second characters are different colors.

37. The array of toilet tissue products of claim 36, wherein the first and second characters are animals of the same type.

38. The array of toilet tissue products of claim 34, wherein the first and second characters are in different active poses.

39. The array of toilet tissue products of claim 34, further comprising a marketing article selected from the group consisting of: in-store flyers, periodical ads, billboards, pallet wrappers, corrugated boxes, window stick-on ads, shelf talkers, and combinations thereof for use in marketing the first and second toilet tissue products, the marketing article comprising the first character representation exhibiting a first active pose and the second character representation exhibiting a second active pose different from the first active pose.

40. The array of toilet tissue products of claim 1, wherein the common single source identifier is a brand name.

* * * * *